US010851989B2

(12) United States Patent
Lee et al.

(10) Patent No.: US 10,851,989 B2
(45) Date of Patent: Dec. 1, 2020

(54) COOKER AND STEAM GENERATOR

(71) Applicant: LG ELECTRONICS INC., Seoul (KR)

(72) Inventors: Sangcheol Lee, Seoul (KR); Wansoo Kim, Seoul (KR); Yangkyeong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 633 days.

(21) Appl. No.: 14/953,058

(22) Filed: Nov. 27, 2015

(65) Prior Publication Data

US 2016/0150906 A1 Jun. 2, 2016

(30) Foreign Application Priority Data

Nov. 27, 2014 (KR) ..... 10-2014-0167626

(51) Int. Cl.

| | |
|---|---|
| ***F22B 1/28*** | (2006.01) |
| ***F24C 15/00*** | (2006.01) |
| ***F24C 15/32*** | (2006.01) |
| ***A47J 27/04*** | (2006.01) |

(52) U.S. Cl.
CPC ..... *F22B 1/284* (2013.01); *F24C 15/003* (2013.01)

(58) Field of Classification Search
CPC ..... F22B 1/284; F24C 15/003
See application file for complete search history.

(56) References Cited

U.S. PATENT DOCUMENTS 1,975,396 A * 10/1934 Jenson ..... C10B 21/20 202/108
2,350,335 A * 6/1944 Baker ..... A47J 31/053 126/369
3,160,145 A * 12/1964 Miller ..... F24H 9/0026 110/322
8,648,281 B2 * 2/2014 Utsumi ..... F24C 15/327 126/20

(Continued)

FOREIGN PATENT DOCUMENTS

EP 1437547 A2 * 7/2004 ..... F22B 1/284
EP 2417881 A2 * 2/2012 ..... F24C 15/327

OTHER PUBLICATIONS

Ching, Francis D.K.; "A Visual Dictionary of Architecture"; 1995; John Wiley & Sons, Inc.; pp. 203.*

*Primary Examiner* — Jorge A Pereiro
*Assistant Examiner* — Logan P Jones
(74) *Attorney, Agent, or Firm* — Fish & Richardson P.C.

(57) ABSTRACT

A cooker includes a steam generator that supplies steam into a cooking chamber of the cooker. The steam generator includes a heating chamber having a heating space; a steam discharge port through which steam in the heating space is discharged; a residual water discharge port through which steam water in the heating space is discharged; a heater that heats the heating space; and a residual water discharge pipe connected with the residual water discharge port and that selectively discharges steam water from the heating space to an outside. A first end of the residual water discharge pipe is connected with the residual water discharge port, a second end of the residual water discharge pipe is arranged lower than the residual water discharge port, and a portion of the residual water discharge pipe between the first and second ends is arranged higher than the residual water discharge port.

18 Claims, 8 Drawing Sheets

(56) References Cited

U.S. PATENT DOCUMENTS

| | | | | |
|---|---|---|---|---|
| 9,788,678 | B2 * | 10/2017 | Abe | F24C 15/327 |
| 9,841,182 | B2 * | 12/2017 | Shibuya | F22B 1/284 |
| 9,890,946 | B2 * | 2/2018 | Shibuya | F22B 1/28 |
| 2015/0177744 | A1 * | 6/2015 | Choi | F22B 1/284<br>137/606 |

* cited by examiner

COOKER AND STEAM GENERATOR

CROSS-REFERENCE TO RELATED APPLICATION(S)

The present application claims the benefit of an earlier filing date and right of priority under 35 U.S.C. §119 to Korean Application No. 10-2014-0167626, filed in Korea on Nov. 27, 2014, which is hereby incorporated by reference in its entirety.

FIELD

The present disclosure relates to a cooker and a steam generator.

BACKGROUND

Examples of heating devices that are used to cook food include a microwave oven using a high frequency, a gas oven or an electric oven which directly heats the food using a heater, and a steam cooker which supplies heat to the food through steam.

Microwave ovens typically have a disadvantage in that food becomes dry after cooking and thus the taste of food is degraded, while gas and electric ovens typically have a disadvantage in that cooking time is increased and efficiency is reduced due to a low coefficient of heat transfer of air.

However, steam cookers have an advantage that food may retain proper moisture, and thus proper food taste may be better maintained. Also, since steam has a relatively good coefficient of heat transfer when used as a heat transfer medium, the cooking time of steam cookers may be reduced, and efficiency thereof may be enhanced.

SUMMARY

The present disclosure is directed to providing a cooker which is able to remove residual water in a steam generator.

According to one aspect, a cooker may include a cavity having a cooking chamber formed therein; a door configured to open and close the cooking chamber; and a steam generator connected with the cavity and configured to supply steam into the cooking chamber. The steam generator may include a heating chamber having a heating space formed therein; a steam discharge port through which the steam in the heating space is discharged; a residual water discharge port through which steam water in the heating space is discharged; a heater provided at the heating chamber and configured to provide heat to the heating space; and a residual water discharge pipe connected with the residual water discharge port and configured to selectively discharge the steam water in the heating space to an outside of the steam generator. A first end of the residual water discharge pipe may be connected with the residual water discharge port, and a second end of the residual water discharge pipe may be located at a position lower than the residual water discharge port. A portion of the residual water discharge pipe that is between the first end and the second end may be arranged at a position higher than the residual water discharge port.

In some implementations, the residual water discharge pipe may include a first pipe portion connected with the residual water discharge port and gradually directed upward as being far from the residual water discharge port; and a second pipe portion configured to be in communication with an upper end of the first pipe portion and to form a combination point of the residual water discharge pipe, wherein a lower end of the second pipe portion is disposed at a position lower than the residual water discharge port.

In some implementations, the steam generator is configured such that when the heater is operated and heats the steam water in the heating space, the steam water is maintained at a water level which is lower than a height of the combination point of the residual water discharge pipe.

In some implementations, the cooker is further configured to remove the steam water in the heating space by supplying the steam water into the heating space so that a level of the steam water in the heating space is higher than the height of the combination point of the residual water discharge pipe.

In some implementations, the cooker further includes a water supply pipe configured to supply the steam water into the steam generator, and a water supply pump connected with the water supply pipe.

In some implementations, the heating chamber further includes a water supply port configured to supply the steam water into the heating space, and the combination point of the residual water discharge pipe is located at a position lower than the water supply port.

In some implementations, the heating chamber further includes a first protruding portion formed by a part of the heating chamber that protrudes towards an outside of the steam generator and that is configured to expand the heating space.

In some implementations, the heating chamber further includes a baffle fixed to an inner surface of the heating chamber at a position higher than the first protruding portion of the heating chamber and configured to prevent the steam water in the heating space from being discharged to the steam discharge port.

In some implementations, the heating chamber further includes a surface area expansion portion provided at an inner surface of the heating chamber that is configured to expand a surface area of the inner surface of the heating chamber.

In some implementations, the heating chamber includes a chamber body, a chamber cover coupled to the chamber body, and wherein the heating space is formed between the chamber body and the chamber cover.

In some implementations, a recessed portion that is recessed toward the heating space is provided at an outer surface of the chamber body, and a thermistor configured to measure a temperature of the heating space is provided at the recessed portion.

In some implementations, the steam generator of the cooker is configured to selectively discharge, through the residual water discharge pipe, the steam water in the heating space to an outside of the steam generator by increasing the level of the steam water accommodated in the heating space such that the level of the steam water in the heating space is greater than a threshold water level.

In some implementations, the steam generator of the cooker is configured to selectively discharge, through the residual water discharge pipe, the steam water in the heating space to an outside of the steam generator by controlling the water supply pump to supply the steam water into the heating space such that the level of the steam water accommodated in the heating space is greater than a threshold water level.

In another aspect, a steam generator is disclosed. The steam generator may include a heating chamber having a heating space formed therein; a steam discharge port formed at an upper portion of the heating chamber and through which steam in the heating space is discharged; a residual water discharge port formed at a lower portion of the heating chamber and through which steam water in the heating space is discharged; a heater provided at the heating chamber and configured to provide heat to the heating space; and a residual water discharge pipe connected with the residual water discharge port and configured to selectively discharge the steam water in the heating space to an outside of the steam generator. A first end of the residual water discharge pipe may be connected with the residual water discharge port, and a second end of the residual water discharge pipe may be located at a position lower than the residual water discharge port. A portion of the residual water discharge pipe that is between the first end and the second end may be arranged at a position higher than the residual water discharge port.

In some implementations, the steam generator further includes a water supply port configured to supply the steam water into the heating chamber. The residual water discharge pipe may be located at a position lower than the water supply port.

In some implementations, the steam generator is further configured to selectively discharge, through the residual water discharge pipe, the steam water in the heating space to an outside of the steam generator by increasing the level of the steam water accommodated in the heating space such that the level of the steam water in the heating space is greater than a threshold water level.

In some implementations, the steam generator is further configured to selectively discharge, through the residual water discharge pipe, the steam water in the heating space to an outside of the steam generator by controlling the water supply pump to supply the steam water into the heating space such that the level of the steam water accommodated in the heating space is greater than a threshold water level.

DETAILED DESCRIPTION

In some implementations, a steam cooker has a steam generator for producing steam which will be supplied to a cooking chamber. In generating this steam, however, there tends to be a problem that residual water remains inside the steam generator of the cooker. Such residual water can generate scale and cause problems in hygiene. To address this problem, some steam generators are configured to remove the residual water therein. Examples of such steam generators include those in which residual water in the steam generator is evaporated by applying heat and those in which residual water is removed using a pump.

However, steam generators in which residual water is evaporated by applying heat tend to have a problem in which scale is nonetheless generated at an inside of the steam generator. Also, steam generators in which residual water is removed using a pump tend to have a complicated structure and a high production cost.

Systems disclosed herein enable a steam generator that removes residual water from within by introducing additional water into the steam generator and thereby taking advantage of the siphoning phenomenon to discharge the residual water out of the steam generator. In some implementations, during normal operation the steam generator maintains the water level inside the steam generator below a threshold. However, when removing residual water that remains after operation of the cooker, the steam generator may introduce additional water into the steam generator such that the aggregate water level rises above the threshold and induces a siphoning phenomenon, thereby causing the residual water and the additional water to discharge out of the steam generator via a discharge pipe. Such implementations may enable a simpler and more cost-effective technique of removing residual water from inside a steam cooker.

Figure 1:
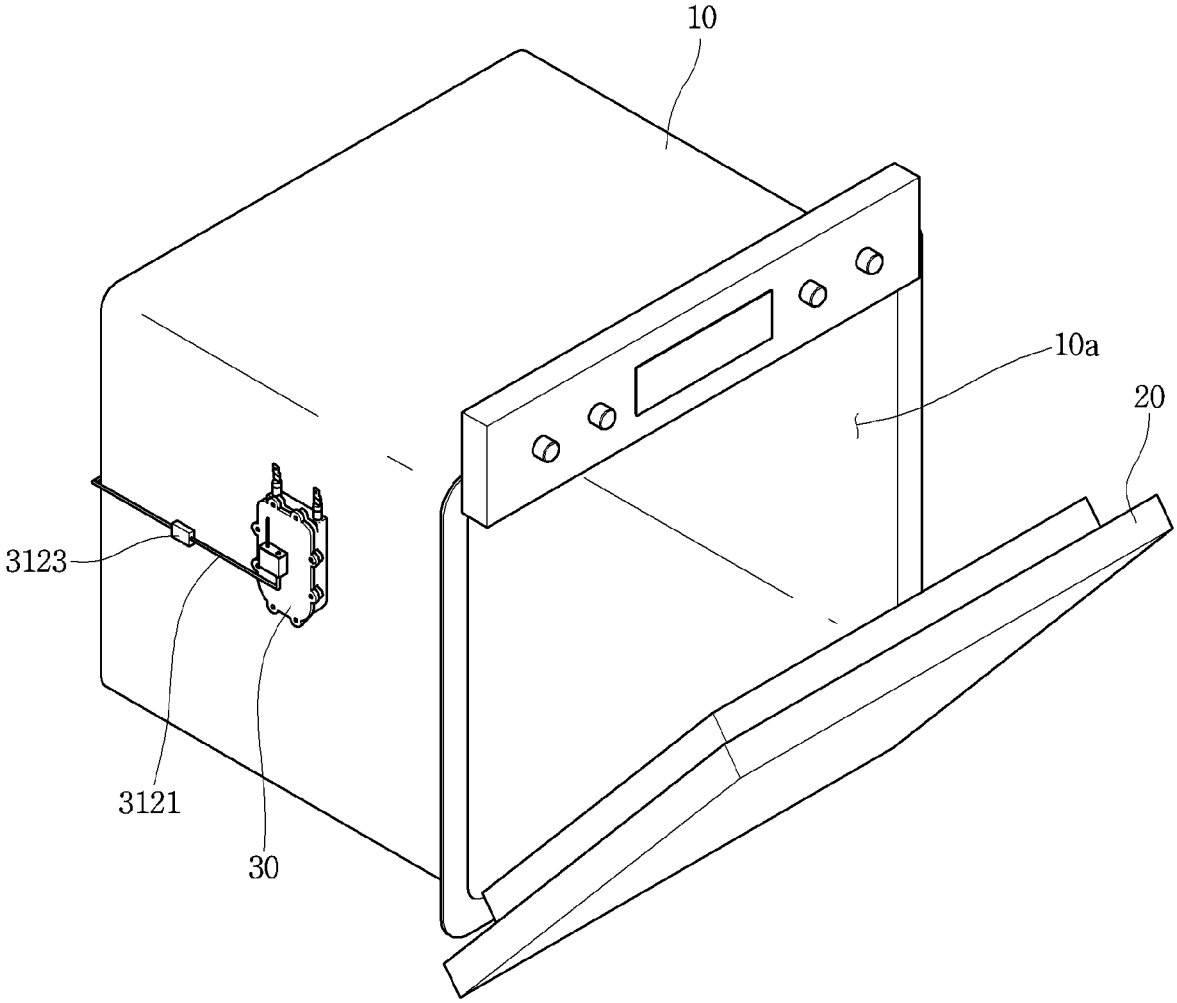
FIG. 1 is a perspective view of an example of a cooker.

FIG. 1 is a perspective view of a cooker according to one implementation.

Referring to FIG. 1, a cooker 1 according to one implementation may include a cavity 10, a door 20 and a steam generator 30.

The cavity 10 may be provided at an inside of a case which forms an external appearance of the cooker 1.

A space in which food is cooked may be formed in the cavity 10. The food may be cooked by steam.

More specifically, a cooking chamber 10*a* for cooking the food is formed in the cavity 10. The cooking chamber 10*a* is opened to one side thereof.

The door 20 which opens and closes an opening of the cooking chamber 10*a* may be installed at one side of the case or the cavity 10.

For example, the door 20 may be rotatably installed at a lower end of one side of the cavity 10. Therefore, an upper end of the door 20 may be rotated using a lower end thereof as an axis and thus may open and close the cooking chamber 10*a*.

Meanwhile, the steam generator 30 which generates the steam may be installed at one side of the cavity 10.

The steam generator 30 may evaporate steam water accommodated therein and may generate the steam.

The cooker 1 may further include a water supply tank.

The steam water is stored in the water supply tank. The water supply tank is connected with the steam generator 30, and thus may supply the steam water into the steam generator 30.

Hereinafter, the steam generator 30 will be described with reference to the drawings.

Figure 2:
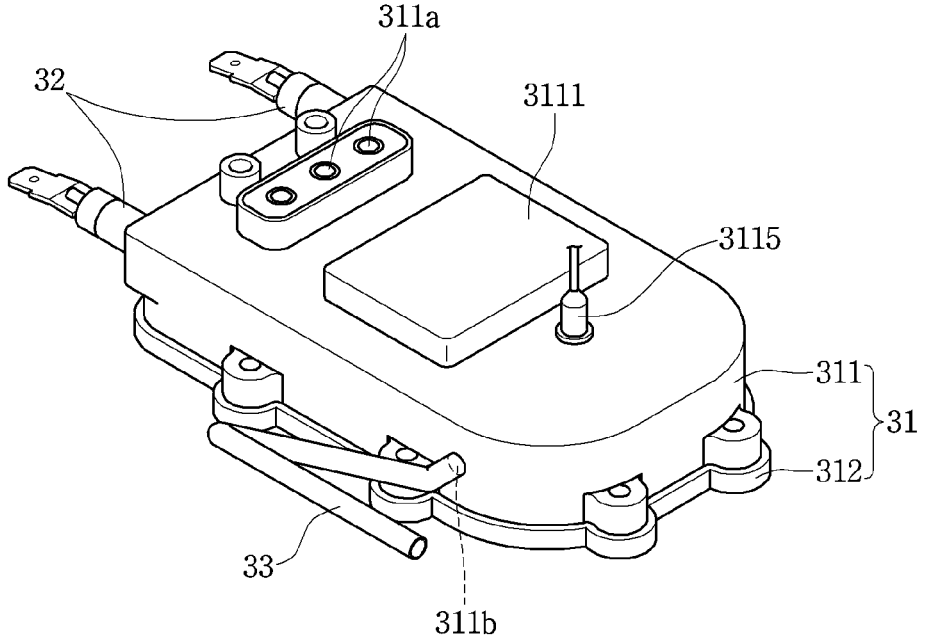
FIG. 2 is a perspective view of an example of a steam generator of a cooker.
Figure 3:
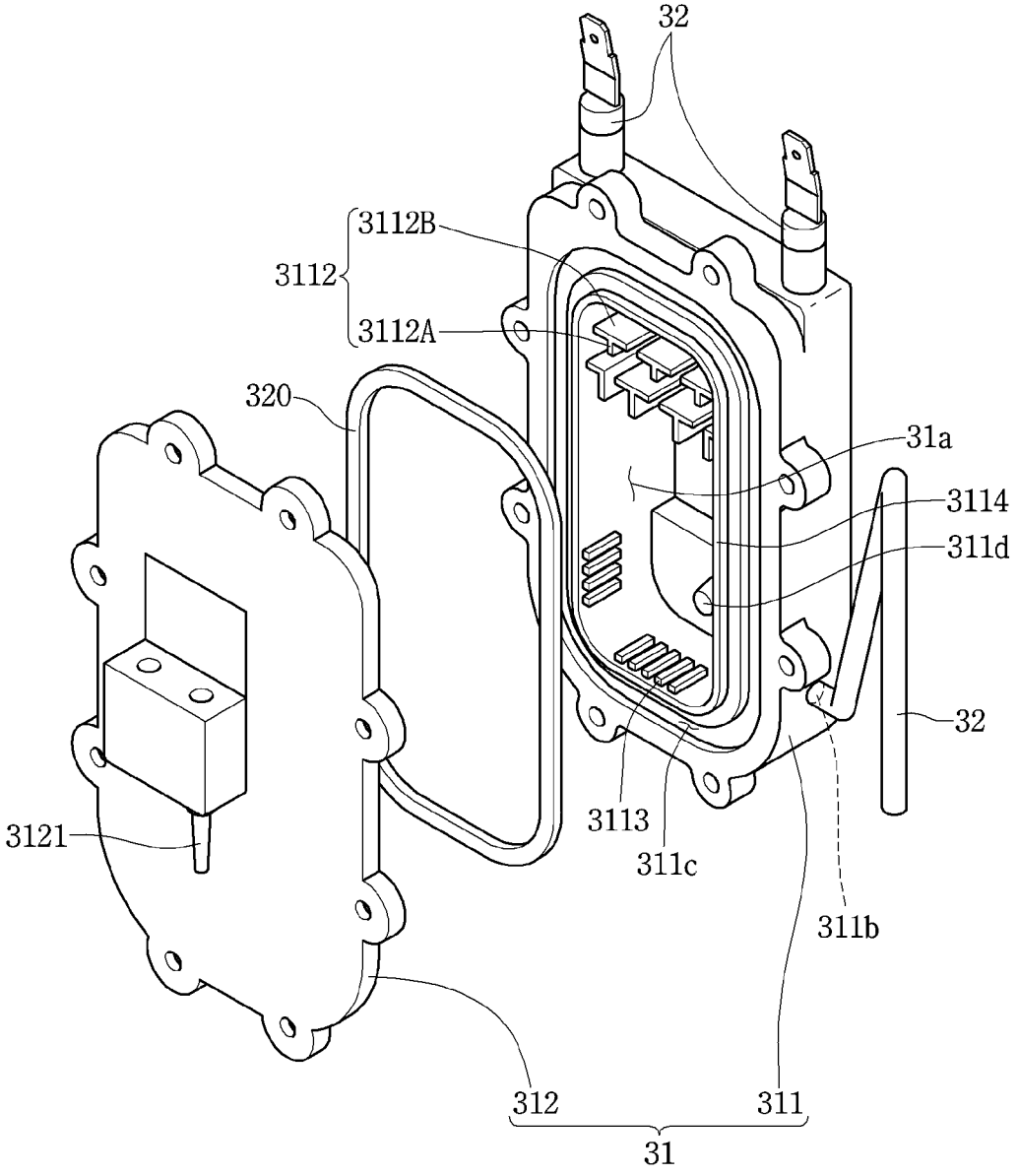
FIG. 3 is a first exploded perspective view of an example of a steam generator of a cooker.
Figure 4:
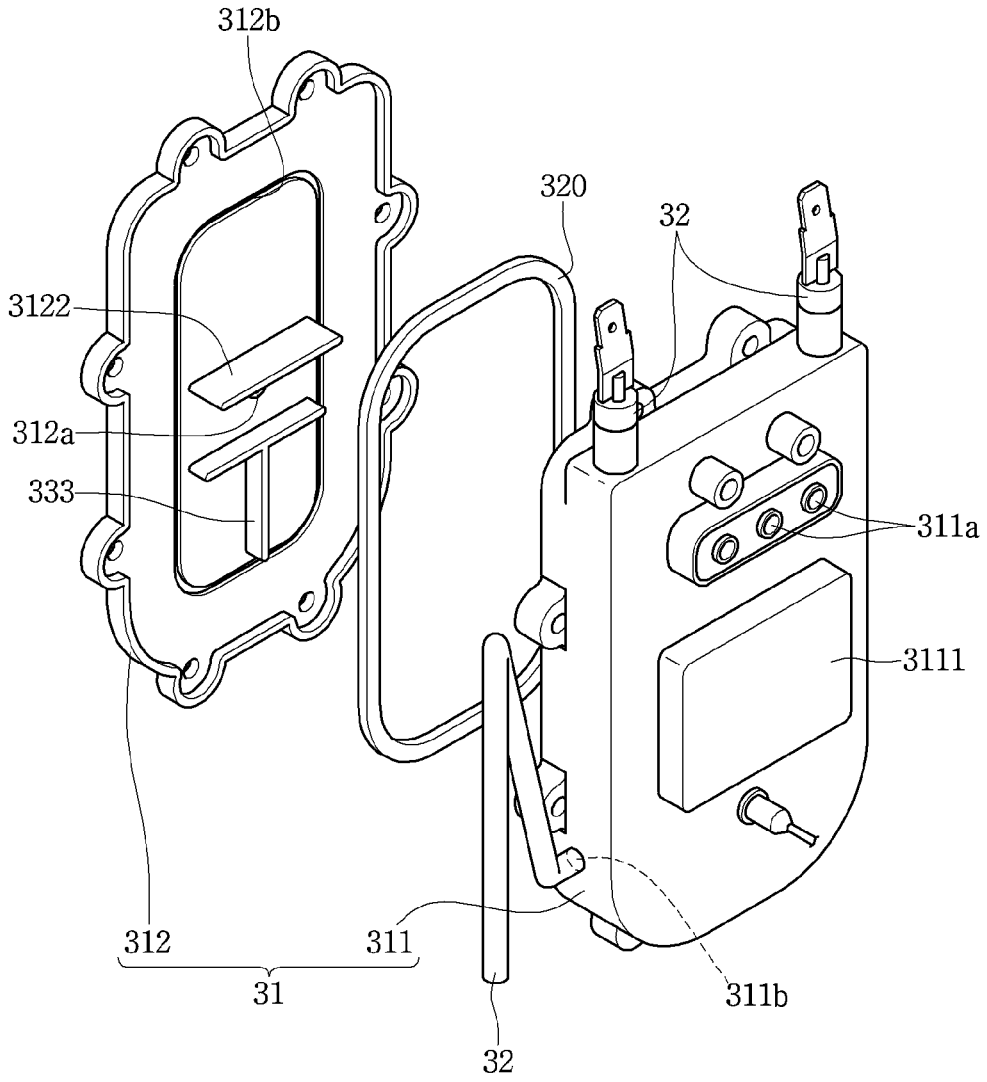
FIG. 4 is a second exploded perspective view of an example of a steam generator of a cooker.

FIG. 2 is a perspective view of the steam generator of the cooker of FIG. 1, FIG. 3 is a first exploded perspective view of the steam generator of FIG. 2, and FIG. 4 is a second exploded perspective view of the steam generator of FIG. 2.

Referring to FIGS. 2 to 4, as described above, the steam generator 30 generates the steam which will be supplied into the cooking chamber 10*a*.

The steam generator 30 may include a heating chamber 31, a steam heater 32 and a residual water discharge pipe 33.

A heating space 31*a* in which the steam water is stored is provided at the heating chamber 31. The heating chamber 31 may be fixed to one side of the cavity 10 from an outside of the cavity 10.

The heating chamber 31 may include a chamber body 311 and a chamber cover 312.

Therefore, the heating space 31*a* may be formed between the chamber body 311 and the chamber cover 312 in a state in which the chamber body 311 and the chamber cover 312 are coupled to each other.

A shape and a size of the heating space 31*a* are not limited. However, the heating space 31*a* may be formed so that a vertical cross section thereof is relatively wider than a horizontal cross section thereof. This is to increase reheating efficiency of the steam by the steam heater 32.

Also, the chamber body 311 may have a first protruding portion 3111. The first protruding portion 3111 is formed such that a part of the chamber body 311 protrudes to an outside and thus the heating space 31*a* is able to expand.

Since the heating space 31*a* expands by the first protruding portion 3111, a large amount of water may be accommodated in the heating space 31*a*.

One or more steam discharge ports 311*a* are formed at the chamber body 311. The steam in the heating space 31*a* flows to the cooking chamber 10*a* through the steam discharge ports 311*a*.

The steam discharge ports 311*a* are formed at an upper portion of the chamber body 311 to be in communication with the heating space 31*a*.

That is, the steam generated in the heating space 31*a* of the chamber body 311 may flow to the cooking chamber 10*a* through the steam discharge ports 311*a* disposed at the upper portion of the chamber body 311.

The steam discharge ports 311*a* are in communication with a steam injection hole which is formed at the cavity 10 in a state in which the steam generator 30 is fixed to the cavity 10.

A residual water discharge port 311*b* is formed at a lower portion of the chamber body 311.

The steam water remaining in the heating space 31*a* may be discharged to an outside through the residual water discharge port 311*b*.

The residual water discharge port 311*b* may be arranged at a height which is the same as a lowermost point of the heating space 31*a*, but is not always limited thereto.

Also, one or more baffles 3112 are provided at an inner surface of the chamber body 311.

The baffles 3112 may be fixed to the inner surface of the chamber body 311 between the first protruding portion 3111 and the steam discharge ports 311*a*.

That is, the baffles 3112 are arranged at a position of the inner surface of the chamber body 311 which is higher than the first protruding portion 3111 and lower than the steam discharge ports 311*a*.

The baffles 3112 serve to restrict movement of the steam which flows from the heating space 31*a* to the steam discharge ports 311*a*.

Therefore, the steam which flows from the heating space 31*a* to the steam discharge ports 311*a* by the baffles 3112 may be reheated by the steam heater 32.

The baffles 3112 protrude from the inner surface of the chamber body 311 and divide a part of the heating space 31*a* *horizontally and vertically.*

To this end, the baffles 3112 may include a guide portion 3112A which extends vertically and an interference portion 31128 which horizontally extends from an upper end of the guide portion 3112A.

A surface area expansion portion 3113 is provided at the inner surface of the chamber body 311 which forms the heating space 31*a*.

The surface area expansion portion 3113 may expand an inner area of the chamber body 311, and thus may reduce a heat flux generated when the steam water is heated.

A close contact rib 3114 is provided at one surface of the chamber body 311 close to an edge of the heating space 31*a*. The close contact rib 3114 is formed to protrude, such that a part of the one surface of the chamber body 311 has a closed curve shape.

Also, a first packing insertion groove 311*c* is formed at one surface of the chamber body 311 corresponding to an outside of the close contact rib 3114. A first packing member 320 is inserted into the first packing insertion groove 311*c*.

The first packing insertion groove 311*c* is formed to be recessed, such that the one surface of the chamber body 311 has a closed curve shape to surround the close contact rib 3114.

A thermistor 3115 may be provided at the chamber body 311. The thermistor 3115 may measure a temperature of the heating space 31*a*.

The thermistor 3115 may be installed at a recessed portion 311*d* which is recessed at an outer surface of the chamber body 311 toward the heating space 31*a*.

The thermistor 3115 is installed at the chamber body 311, and thus may accurately measure a temperature of the steam water in the heating space 31*a* *through the chamber body* 311.

The chamber cover 312 is fastened to the chamber body 311.

A water supply port 312*a* which supplies the steam water into the heating space 31*a* is formed at the chamber cover 312.

The water supply port 312*a* may be located at an upper side of a maximum water level H1 at which the steam water is maximally accommodated in the heating space 31*a*.

A water supply pipe 3121 is provided at the chamber cover 312. The water supply tank is connected with the water supply pipe 3121, and thus the steam water in the water supply tank may be supplied to the heating space 31*a* through the water supply pipe 3121.

An end of the water supply pipe 3121 may be installed to be exposed to an inside of the heating space 31*a* through the water supply port 312*a* of the chamber cover 312, or to be inserted into the water supply port 312*a*.

Meanwhile, a water supply pump 3123 may be connected to the water supply pipe 3121. The water supply pump 3123 enables the steam water to flow in the water supply pipe 3121.

Meanwhile, an overflow prevention portion 3122 is provided at the chamber cover 312. The overflow prevention portion 3122 serves to prevent the steam water stored in the heating space 31*a* from boiling over through the steam discharge port 311*a*. To this end, the overflow prevention portion 3122 is formed between the water supply port 312*a* and the baffles 3112 to protrude toward the heating space 31*a*.

Meanwhile, a close contact groove 312*b* is formed at the chamber cover 312. The close contact groove 312*b* is formed by recessing a part of the chamber cover 312 to be matched with the close contact rib 3114.

Therefore, while the chamber cover 312 is fastened to the chamber body 311, the close contact rib 3114 is inserted into the close contact groove 312*b*.

The first packing member 320 is provided between the chamber body 311 and the chamber cover 312. The first packing member 320 serves to prevent the steam water stored in the heating space 31*a* from leaking.

When an inner surface of the chamber cover 312 is in close contact with a front surface of the chamber body 311, the first packing member 320 is in contact with the inner surface of the chamber body 311, while being inserted into the first packing insertion groove 311*c*.

The steam heater 32 heats the steam water stored in the heating space 31*a*, and generates the steam which will be supplied to the cooking chamber 10*a*. To this end, the steam heater 32 may be inserted into the chamber body 311 and may be overall formed in a U shape to be positioned adjacent to both side ends and a bottom portion of the heating space 31*a*, but is not limited thereto.

Heat of the steam heater 32 is transferred to the steam water stored in the heating space 31*a* through the heating chamber 31, i.e., the chamber body 311 and the chamber cover 312.

Figure 5:
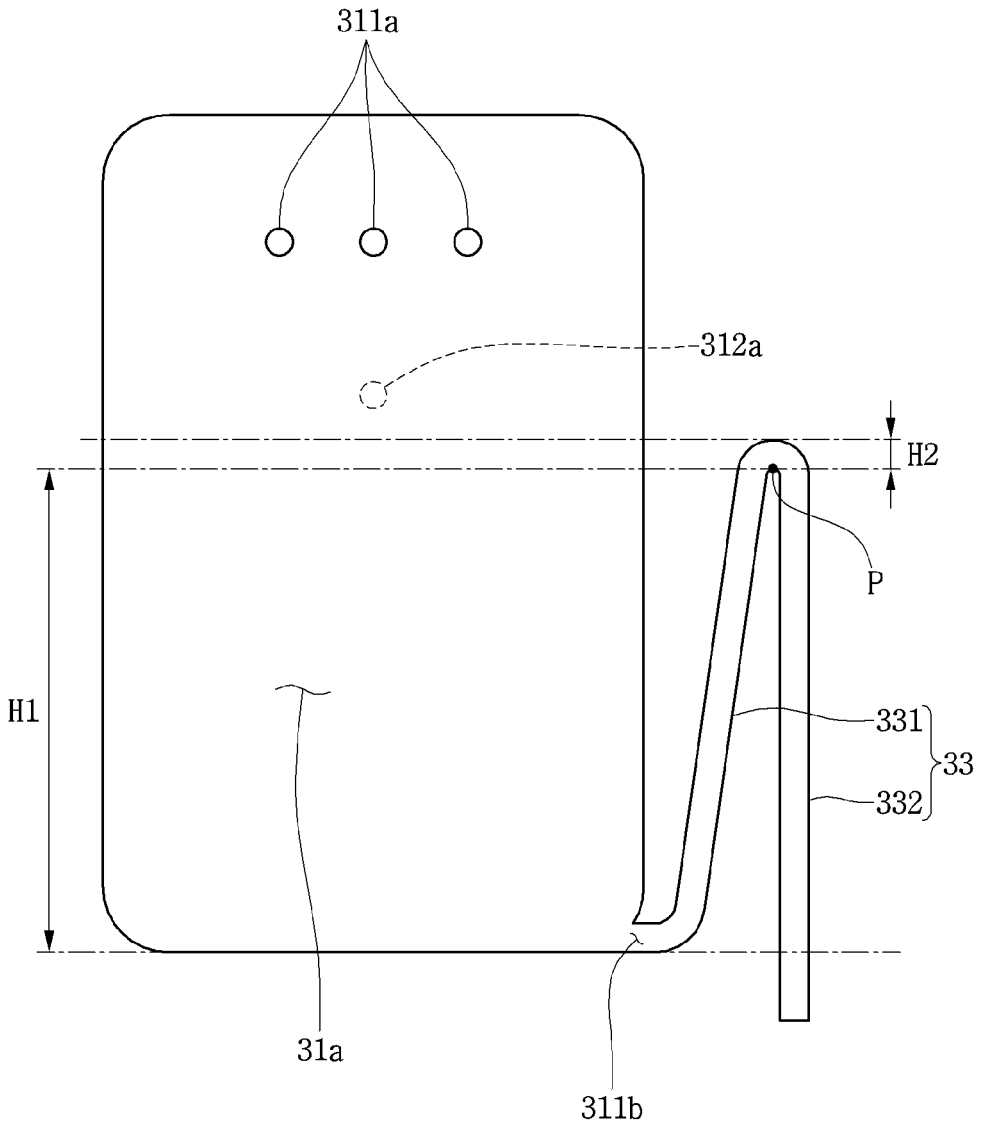
FIG. 5 is a schematic view illustrating an example of a state in which a discharge pipe is connected with a heating space in a steam generator of a cooker.
Figure 6:
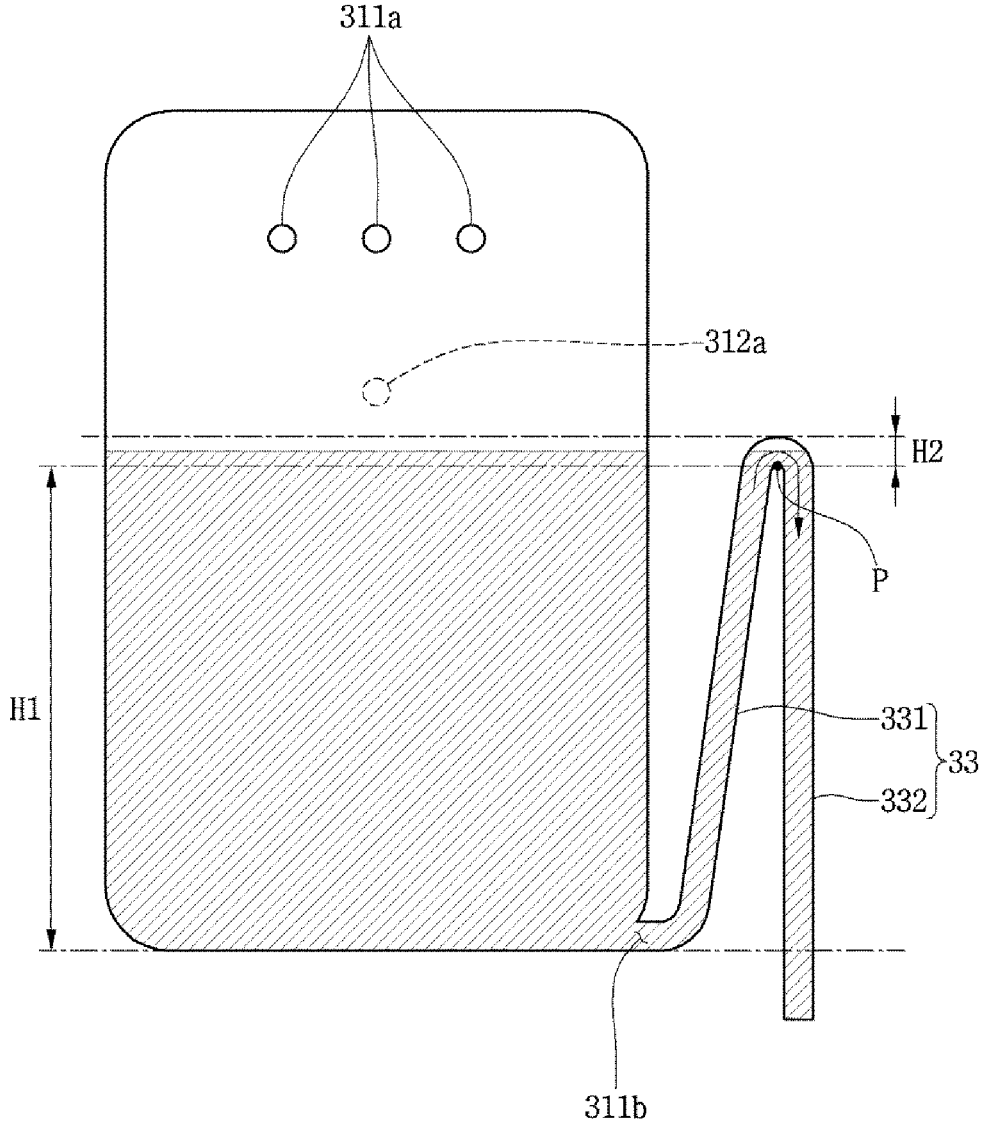
FIG. 6 is a view illustrating an example in which steam water is maintained at a maximum water level in the heating space of a steam generator of a cooker.
Figure 7:
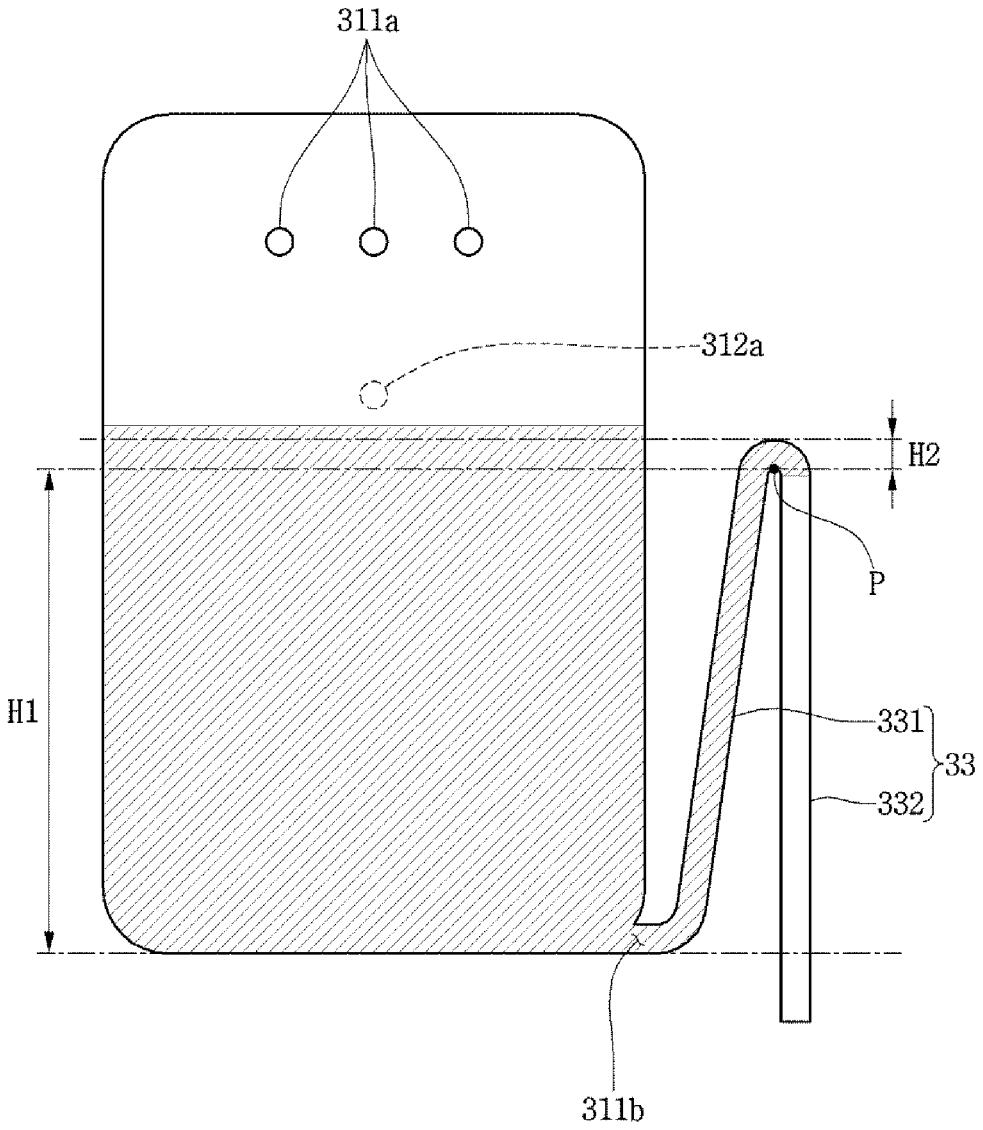
FIGS. 7 and 8 are views illustrating examples of a process in which the steam water in a heating space of a steam generator is discharged to a residual water discharge pipe by a siphon phenomenon.
Figure 8:
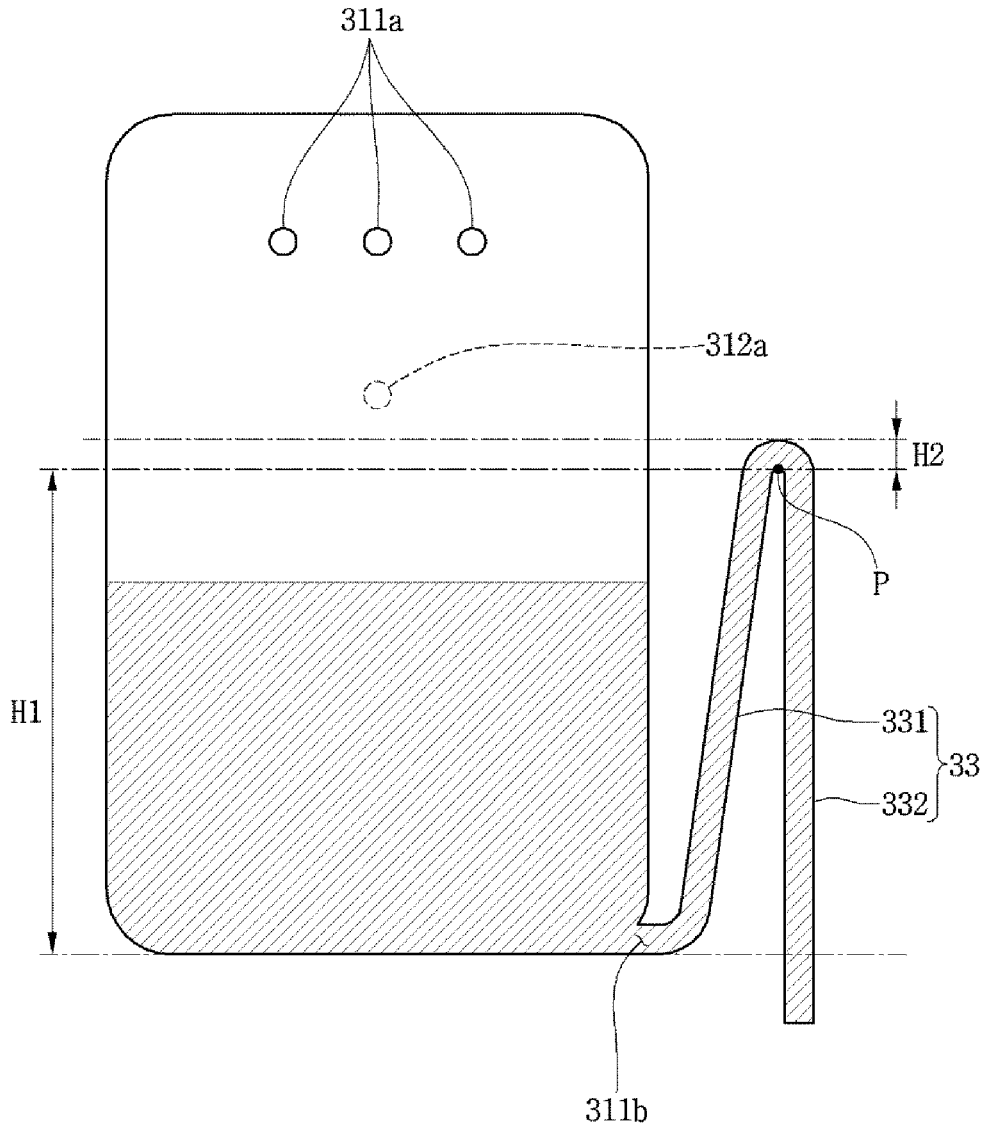

FIG. 5 is a schematic view illustrating a state in which the discharge pipe is connected with the heating space in the steam generator of FIG. 2, FIG. 6 is a view illustrating a principle in which the steam water is maintained at the maximum water level in the heating space of FIG. 5, and FIGS. 7 and 8 are views illustrating a process in which the steam water is discharged to the discharge pipe by a siphon phenomenon in the heating space of FIG. 5.

Referring to FIG. 5, the residual water discharge pipe 33 is connected with the residual water discharge port 311*b*, and may selectively discharge the steam water in the heating space 31*a* to an outside.

One end of the residual water discharge pipe 33 is connected with the residual water discharge port 311*b*, and the other end thereof is located at a position lower than the residual water discharge port 311*b*. A part of the residual water discharge pipe 33 is disposed at a position higher than the residual water discharge port 311*b*.

The residual water discharge pipe 33 may include a first pipe 331 and a second pipe 332.

The first pipe 331 is connected with the residual water discharge port 311*b*, and gradually directed upward as being far from the residual water discharge port 311*b*.

An upper end of the second pipe 332 is in communication with an upper end of the first pipe 331, and forms a combination point P, and a lower end thereof is disposed at a position lower than the residual water discharge port 311*b*.

The combination point P may be formed at the same height as the maximum water level H1. Therefore, the combination point P may be formed at a position lower than the water supply port 312*a*.

Referring to FIG. 6, the residual water discharge pipe 33 may discharge the steam water having a water level higher than the combination point P to the outside.

More specifically, the residual water discharge pipe 33 may discharge the steam water which is located at an erroneous water level H2, and thus may maintain the steam water of the heating space 31*a* at the maximum water level H1. Therefore, the steam water which is higher than the maximum water level H1 and within the erroneous water level H2 does not cause a siphon phenomenon.

That is, the residual water discharge pipe 33 may discharge the steam water, which is located at the position higher than the combination point P and within the erroneous water level H2, without the siphon phenomenon, and thus the steam water in the heating space 31*a* may be maintained at the maximum water level H1.

Therefore, the residual water discharge pipe 33 may prevent the steam water stored in the heating space 31*a* from flowing back through the water supply port 312*a*, and may also prevent an overload of the water supply pump 3123 which supplies the stem water into the heating space 31*a*.

Referring to FIGS. 7 and 8, the residual water discharge pipe 33 may discharge all of the steam water stored in the heating space 31*a*.

When the steam water introduced into the heating space 31*a* through the water supply port 312*a* is temporarily accommodated at the erroneous water level H2 or higher, all of the steam water in the heating space 31*a* may be discharged to the outside through the residual water discharge pipe 33 due to the siphon phenomenon.

The steam generator 30 may further include a control part or a control unit. The control part may be integrated into the steam generator 30 or may be a separate unit that is communicative with the steam generator 30.

When the steam heater 32 is operated to heat the steam water in the heating space 31*a*, the control part may control a level of the steam water in the heating space 31*a* at the maximum water level or less.

Also, when the steam water in the heating space 31*a* is removed, the control part may supply the steam water into the heating space 31*a* and thus may control the level of the steam water to be temporarily higher than the combination point P of the residual water discharge pipe.

That is, the control part may supply the steam water into the heating space 31*a* to the erroneous water level H2 or higher so that the steam water in the heating space 31*a* is discharged to the outside through the residual water discharge pipe 33 due to the siphon phenomenon.

Therefore, the steam generator 30 does not necessarily need a separate drain pump, and the steam water may be completely or substantially completely removed from the heating space 31*a* by supplying the steam water into the heating space 31*a* through the water supply pump 3123 to discharge the steam water from the steam generator 30 to the outside, and thus the steam generator 30 may have a simple structure, and a manufacturing cost thereof may also be reduced.

Hereinafter, an operation process of the steam generator 30 will be described.

First, the control part operates the water supply pump 3123 to supply the steam from the steam generator 30 into the cooking chamber 10*a*. Then, the steam water may be supplied into the heating space 31*a* by the water supply pump 3123.

The control part may control the level of the steam water in the heating space 31*a* based on volume information of the heating space 31*a* and capacity information of the water supply pump 3123.

When the steam water reaches the maximum water level H1, the control part may control the water supply pump 3123 so that the level of the steam water in the heating space 31*a* is located within the erroneous water level H2, and thus the steam water in the heating space 31*a* may be maintained at the maximum water level H1.

Then, to discharge the steam water remaining in the steam generator 30, the control part may control the water supply pump 3123 to supply the steam water, such that the level of the steam water accommodated in the heating space 31*a* is located at the erroneous water level H2 or higher.

When the level of the steam water accommodated in the heating space 31*a* is located at the erroneous water level H2 or higher, all of the steam water in the heating space 31*a* may be discharged to the outside through the residual water discharge port 311*b* due to the siphon phenomenon.

Even though all the elements of the implementations are coupled into one or operated in the combined state, the present disclosure is not limited to such an implementation. That is, all the elements may be selectively combined with each other.

Although some examples have been described with reference to a number of illustrative implementations, it will be understood by those skilled in the art that various changes in form and details may be made therein. Therefore, the above implementations should be considered in descriptive sense only and not for purposes of limitation, and also the technical scope of this disclosure is not limited to the implementations described above.

What is claimed is:

1. A cooker comprising:

a cavity having a cooking chamber formed therein;

a door configured to open and close the cooking chamber; and a steam generator connected with the cavity and configured to supply steam into the cooking chamber, wherein the steam generator comprises:

a heating chamber having a heating space formed therein;

a steam discharge port through which the steam in the heating space is discharged;

a residual water discharge port through which steam water in the heating space is discharged;

a heater provided at the heating chamber and configured to provide heat to the heating space;

a residual water discharge pipe connected with the residual water discharge port and configured to selectively discharge the steam water in the heating space to an outside of the steam generator; and a thermistor that is disposed between the steam discharge port and residual water discharge port and that is configured to measure a temperature of the heating space, wherein a first end of the residual water discharge pipe is connected with the residual water discharge port, and a second end of the residual water discharge pipe is located at a position lower than the residual water discharge port, and a portion of the residual water discharge pipe that is between the first end and the second end is arranged at a position higher than the residual water discharge port, wherein the heating chamber further comprises at least one baffle fixed to an inner surface of the heating chamber and configured to restrict a movement of the steam flowing from the heating space to the steam discharge port, wherein the at least one baffle comprises: (i) a guide portion which vertically extends from the heating chamber and (ii) an interference portion which horizontally extends from an upper end of the guide portion, wherein the steam generator further comprises:

a chamber body;

a chamber cover configured to couple to the chamber body to define the heating chamber with the chamber body;

a water supply port disposed at the chamber cover and configured to supply the steam water into the heating space;

a first protruding portion that protrudes from the chamber body toward an outside of the chamber body, the first protruding portion defining an expanded heating space that extends from the heating space toward the outside of the chamber body, that is disposed vertically above the thermistor, and that is configured to accommodate the steam water supplied into the heating space; and an overflow prevention portion disposed at the chamber cover and configured to prevent the steam water in the heating space from being discharged to the steam discharge port, wherein the at least one baffle is arranged at an inner surface of the chamber body at a position that is higher than the first protruding portion and lower than the steam discharge port, wherein the overflow prevention portion is disposed between the water supply port and the at least one baffle, and protrudes toward the heating space, wherein the thermistor protrudes from an outer surface of the chamber body and is disposed lower than a lower end of the first protruding portion and higher than the residual water discharge port, wherein the residual water discharge pipe comprises:

a first pipe portion that is connected to the residual water discharge port and that extends upward away from the residual water discharge port, and a second pipe portion that is in communication with an upper end of the first pipe portion and that forms a combination point of the residual water discharge pipe at the upper end of the first pipe portion, wherein the combination point is lower than the steam discharge port, and a lower end of the second pipe portion is disposed at a position lower than the residual water discharge port, and wherein the water supply port is located vertically between the steam discharge port and the combination point.

2. The cooker according to claim 1, wherein the second pipe portion is curved around the combination point of the residual water discharge pipe and extends downward.

3. The cooker according to claim 1, wherein the steam generator is configured such that when the heater is operated and heats the steam water in the heating space, the steam water is maintained at a water level which is lower than a height of the combination point of the residual water discharge pipe.

4. The cooker according to claim 1, wherein the cooker is further configured to remove the steam water in the heating space by supplying the steam water into the heating space so that a level of the steam water in the heating space is higher than a height of the combination point of the residual water discharge pipe.

5. The cooker according to claim 4, further comprising:

a water supply pipe configured to supply the steam water into the steam generator, and a water supply pump connected with the water supply pipe.

6. The cooker according to claim 1, wherein the combination point of the residual water discharge pipe is located at a position corresponding to a maximum water level of the heating space.

7. The cooker according to claim 1, wherein the heating chamber further comprises a surface area expansion portion provided at an inner surface of the heating chamber that is configured to expand a surface area of the inner surface of the heating chamber.

8. The cooker according to claim 1, wherein a recessed portion recessed toward the heating space is provided at the outer surface of the chamber body, and the thermistor is disposed at the recessed portion.

9. A steam generator comprising:

a heating chamber having a heating space formed therein;

a steam discharge port formed at an upper portion of the heating chamber and through which steam in the heating space is discharged;

a residual water discharge port formed at a lower portion of the heating chamber and through which steam water in the heating space is discharged;

a heater provided at the heating chamber and configured to provide heat to the heating space; and a residual water discharge pipe connected with the residual water discharge port and configured to selectively discharge the steam water in the heating space to an outside of the steam generator, wherein a first end of the residual water discharge pipe is connected with the residual water discharge port, and a second end of the residual water discharge pipe is located at a position lower than the residual water discharge port, and a portion of the residual water discharge pipe that is between the first end and the second end is arranged at a position higher than the residual water discharge port, wherein the heating chamber further comprises at least one baffle fixed to an inner surface of the heating chamber and configured to restrict a movement of the steam flowing from the heating space to the steam discharge port, wherein the at least one baffle comprises: (i) a guide portion which vertically extends from the heating chamber and (ii) an interference portion which horizontally extends from an upper end of the guide portion, wherein the steam generator further comprises:

a chamber body;

a chamber cover configured to couple to the chamber body to define the heating chamber with the chamber body;

a water supply port disposed at the chamber cover and configured to supply the steam water into the heating space;

a thermistor that is disposed between the steam discharge port and residual water discharge port and that is configured to measure a temperature of the heating space;

a first protruding portion that protrudes from the chamber body toward an outside of the chamber body, the first protruding portion defining an expanded heating space that extends from the heating space toward the outside of the chamber body, that is disposed vertically above the thermistor, and that is configured to accommodate the steam water supplied into the heating space; and an overflow prevention portion disposed at the chamber cover and configured to prevent the steam water in the heating space from being discharged to the steam discharge port, wherein the at least one baffle is arranged at an inner surface of the chamber body at a position that is higher than the first protruding portion and lower than the steam discharge port, wherein the overflow prevention portion is disposed between the water supply port and the at least one baffle, and protrudes toward the heating space, wherein the thermistor protrudes from an outer surface of the chamber body and is disposed lower than a lower end of the first protruding portion and higher than the residual water discharge port, wherein the residual water discharge pipe comprises:

a first pipe portion that is connected to the residual water discharge port and that extends upward away from the residual water discharge port, and a second pipe portion that is in communication with an upper end of the first pipe portion and that forms a combination point of the residual water discharge pipe at the upper end of the first pipe portion, wherein the combination point is lower than the steam discharge port, and a lower end of the second pipe portion is disposed at a position lower than the residual water discharge port, and wherein the water supply port is located vertically between the steam discharge port and the combination point.

10. The steam generator according to claim 9, wherein the second pipe portion is curved around the combination point of the residual water discharge pipe and extends downward.

11. The cooker according to claim 1, wherein the steam generator is configured to selectively discharge, through the residual water discharge pipe, the steam water in the heating space to an outside of the steam generator by:

increasing a level of the steam water accommodated in the heating space such that the level of the steam water in the heating space is greater than a threshold water level.

12. The cooker according to claim 5, wherein the steam generator is configured to selectively discharge, through the residual water discharge pipe, the steam water in the heating space to an outside of the steam generator by:

controlling the water supply pump to supply the steam water into the heating space such that the level of the steam water accommodated in the heating space is greater than a threshold water level.

13. The steam generator according to claim 9, further configured to selectively discharge, through the residual water discharge pipe, the steam water in the heating space to an outside of the steam generator by:

increasing a level of the steam water accommodated in the heating space such that the level of the steam water in the heating space is greater than a threshold water level.

14. The steam generator according to claim 10, further configured to selectively discharge, through the residual water discharge pipe, the steam water in the heating space to an outside of the steam generator by:

controlling the water supply port to supply the steam water into the heating space such that a level of the steam water accommodated in the heating space is greater than a threshold water level.

15. The cooker according to claim 1, wherein the steam generator further comprises:

a recessed portion that protrudes from the inner surface of the chamber body toward the chamber cover, that is configured to receive the thermistor, and that is disposed at a position corresponding to a location of the thermistor lower than the lower end of the first protruding portion and higher than the residual water discharge port.

16. The steam generator according to claim 9, further comprising:

a recessed portion that protrudes from the inner surface of the chamber body toward the chamber cover, that is configured to receive the thermistor, and that is disposed at a position corresponding to a location of the thermistor lower than the lower end of the first protruding portion and higher than the residual water discharge port.

17. The cooker according to claim 1, wherein the upper end of the first pipe portion is disposed vertically below the water supply port.

18. The cooker according to claim 1, wherein a vertical distance between the water supply port and the steam discharge port is greater than a vertical distance between the water supply port and the combination point.

* * * * *